United States Patent [19]

Solberg

[11] 4,438,691

[45] Mar. 27, 1984

[54] SCREW PRESS ARRANGEMENTS

[75] Inventor: Per I. Solberg, Rådal, Norway

[73] Assignee: Stord Bartz A/S, Bergen, Norway

[21] Appl. No.: 345,379

[22] PCT Filed: Jun. 11, 1981

[86] PCT No.: PCT/NO81/00023

§ 371 Date: Feb. 3, 1982

§ 102(e) Date: Feb. 3, 1982

[87] PCT Pub. No.: WO81/03639

PCT Pub. Date: Dec. 24, 1981

[30] Foreign Application Priority Data

Jun. 13, 1980 [NO] Norway ..... 801755

[51] Int. Cl.[3] ..... B30B 9/12

[52] U.S. Cl. ..... 100/117; 100/146

[58] Field of Search ..... 100/117, 145, 146, 147, 100/148, 149, 150, 127, 128, 129

[56] References Cited

U.S. PATENT DOCUMENTS 2,567,219 9/1951 Lesniak ..... 100/146

FOREIGN PATENT DOCUMENTS 570999 8/1945 United Kingdom ..... 100/146

677794 8/1952 United Kingdom ..... 100/146

*Primary Examiner*—Peter Feldman

*Attorney, Agent, or Firm*—Kenyon & Kenyon

[57] ABSTRACT

Screw press arrangement having two or more screw threads arranged side-by-side in a relatively tightly fitting press basket having openings for the drainage of fluid from the material which is fed into the press. At the feeding-in portion the core of the screw element has a relatively small diameter while the screw threads have a large diameter and at the discharge portion the core of the screw elements has a relatively large diameter while the screw threads have a small diameter. Cylindrical sections of the press basket are employed over the largest part of the length of the press and conically tapered sections of the press basket serve as transition and discharge sections respectively. Provision is made for about 20% of the total length of the screw element in the form of the discharge portion to have a uniformly increasing core diameter towards the discharge end and a uniformly decreasing press basket inner diameter.

10 Claims, 7 Drawing Figures

—FIG.6.—

SCREW PRESS ARRANGEMENTS

This invention relates to screw press arrangements.

A screw press which effects a continuous expelling of fluid from various moist material masses, is described in Norwegian Patent Specification No. 56,471 (from 1935) and in the main features the screw presses are built continuously as is described in said patent specification.

Gradually as screw presses have found application in new areas, it has been found that when materials are concerned which give good squeezing out of fluid—and with this also a compact and hard press cake with great friction between the material and the screw surface—there is obtained with the construction of the screw element described in the aforementioned Norwegian patent specification, an insufficient thread engagement between the screw elements over a large portion of the length of the screw element so that the press cake rotates to too great a degree together with the screw elements. As a result the advancement of material is reduced and the effect of squeezing out of fluid is reduced. As a consequence of the material rotating to a large degree with the screw element the pressure which is built up internally in the press basket already begins to decrease strongly at a distance from the discharge end of approximately 30% of the total length of the screw element. This situation is determined by means of special pressure measuring cells which are mounted at suitable mutual distances along the press basket.

An object of the present invention is to eliminte the afore-mentioned disadvantages with these types of presses and particularly the objective is a screw press arrangement where the forward feeding of the material, the squeezing out of fluid and the build up of pressure in the screw press can be improved.

Accordingly the present invention residues in a screw press arrangement having at least two screw elements in side-by-side relation provided with threads having a pitch at least three times greater than their thickness in the axial direction and projecting inwards between threads of an adjacent screw element into intermediate spaces defined thereby and a relatively tightly fitting press basket surrounding the screw elements and having openings for drainage of fluid. Each screw element it is provided with a feed portion having a small core diameter and large thread diameter, a discharge portion with a large core diameter and small thread diameter or without threads and an intermediate portion forming a transition between the feed portion and discharge portion where the press basket is substantially cylindrical in shape. The discharge portion has a length of between 10 and 30% of the total length of a screw element with a core diameter increasing uniformly towards the discharge end and with a uniformly decreasing press basket inner diameter. The sum of the internal press basket radius and core radius in any radial plane in the discharge portion is constant and substantially corresponds to the center distance between the screw elements.

When it is stated above that the sum of internal press basket radius and core radius substantially corresponds to the center distance between the screw elements, it is meant that the screw threads—in the instances the discharge portion is provided with screw threads—substantially form a sliding abutment against the core surface of the adjacent screw element.

In the two-screwed presses hitherto used, one has been heavily committed to maintaining a particular press cake thickness when, for the screw presses of a particular press size and press capacity, there is first determined the core diameter of the screw element and the thread diameter and with this also the center distance between the screw elements. According to Norwegian Patent Specification No. 106,253, it has been found possible to reduce the press cake thickness by cutting in grooves in the core of the screw element for the reception of the threads of the adjacent screw element. An increase of the press cake thickness has been able to be effected relatively easily but then with the consequence that the material slip becomes greater, by virtue of too small a narrowing down of the material passage in the accumulation zone between the screw threads. For a ready built press, there has thus been hitherto, an opportunity to alter the press cake thickness to a minimum degree only.

According to the invention, the discharge portion can, in a manner known per se, be constructed with or without screw threads and the press basket over a corresponding length has a separately replaceable portion. As a result, one can freely choose, all according to which material which is to be treated, an internal press basket diameter and an external core diameter as required so that optimum squeezing out conditions can be obtained for the relevant material. Said in another way, the greater the conicity which is employed for the discharge portion, the smaller the discharge cross-section of the preses cake which is obtained and with this also a correspondingly high material pressure in the discharge end together with improved squeezing out conditions.

In an instance where the discharge portion is without screw threads, this part of the press will act as an effective throttle arrangement and the throttle effect can be regulated as required by employing different displaceable basket sections.

It must be mentioned that the press can act just as effectively with screw elements with opposite thread directions and hence opposite directions of rotation, as with screw elements with the same thread direction and hence the same direction of turn.

When the press cake leaves the press, it has the shape of a hollow cylinder in accordance with the shape of the passage of the press at the discharge end of the screw element. In the construction of the screw element, the aim is optimum efficiency with a high degree of squeezing out of fluid and a particular press cake thickness at the discharge of the press, the height of the gap between the screw elements and the threads respectively at this portion giving a corresponding height. Apart from the desire to have such a completely mutual engagement as possible between the threads in the two screw elements, it is preferred, that the screw element in a length of up to 50% of the total length of the screw element, including the discharge portion, has a thread radius corresponding to the distance from the axis of the screw element to the inner surface of the press basket and to the outer core surface of the adjacent screw element respectively.

In order that the invention can be more clearly understood, convenient embodiments thereof will now be described, by way of example, with reference to the accompanying drawings in which:

FIGS. 1 to 3 each illustrate a vertical longitudinal section, a horizontal section and a cross-section of a screw press of known construction.

Figure 1:
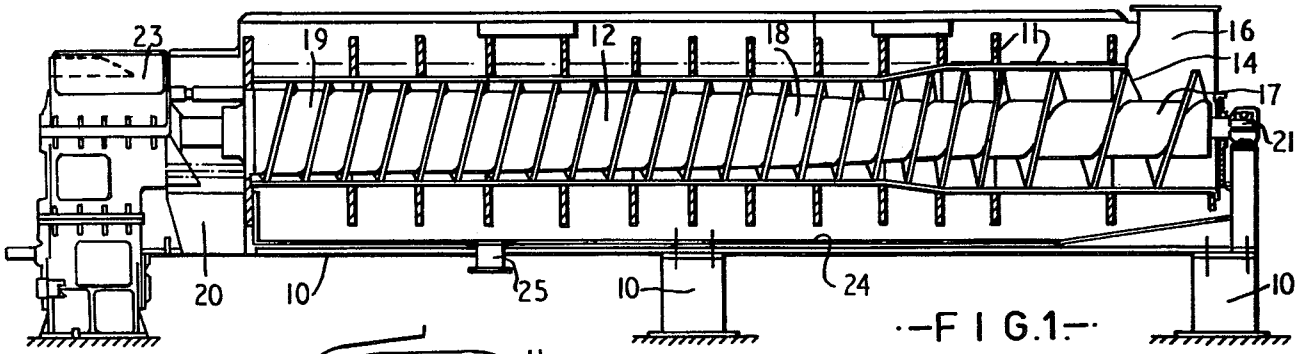
FIG. 1. Prior Art
Figure 3:
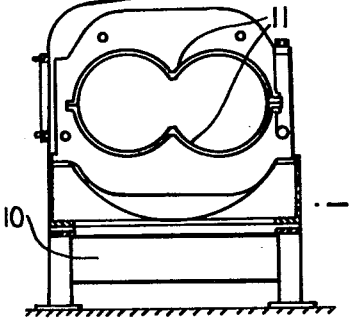
Figure 2:
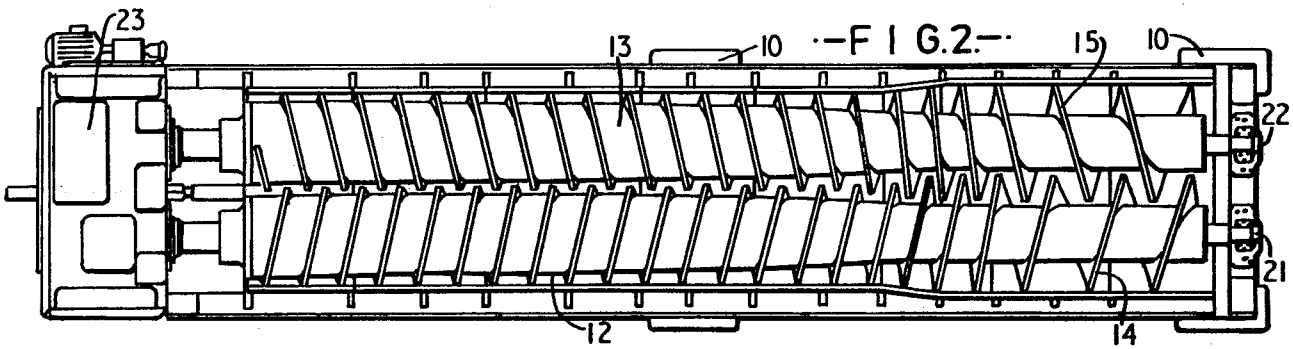

Referring to FIG. 1 to 3, there is shown, generally, a press of known construction. On a stand 10 there is fastened a braced, sectionally divided drainage means in the form of a press basket 11 which surrounds in a relatively tightly fitted manner two rotating screw elements 12, 13 with associated threads 14, 15 and with center axes A, B extending mutually parallel. The screw elements 12, 13 rotate in opposite directions but, alternatively, can be designed in a known manner so that they rotate in the same direction.

The supplies material, that is a wet mass which is to be pressed, is fed at the one end of the press via a vertical downwardly extending hopper 16 to a feed portion 17 of the screw elements 12, 13 and is transported, by means of the screw elements, endways through the press via a central portion 18 and discharge portion 19 to a vertical downwardly extending exhaust duct 20 for the squeezed out mass, that is a press cake itself. The screw elements 12, 13 are mounted at the feed in portion in bearings 21, 22 and at the discharge portion in bearings in connection with a toothed wheel gearing 23 and an associated driving motor (not shown), a reduction in revolutions per minute being provided for from motor to screw elements. Below the whole of the press basket 11, there is arranged a collecting tray 24 with an outlet pipe 25 for the fluid which is squeezed out of the material or the mass of a material.

In the known construction which is illustrated in FIG. 1 to 3, there is total thread engagement, that is the thread on back screw element reaches totally inwards to the core of the adjacent screw element, only at a relatively short portion at the inlet end and the discharge end of the screw elements, while a relatively extended central portion, which has a uniformly increasing screw core diameter, has a varying degree of thread engagement.

Figure 4:
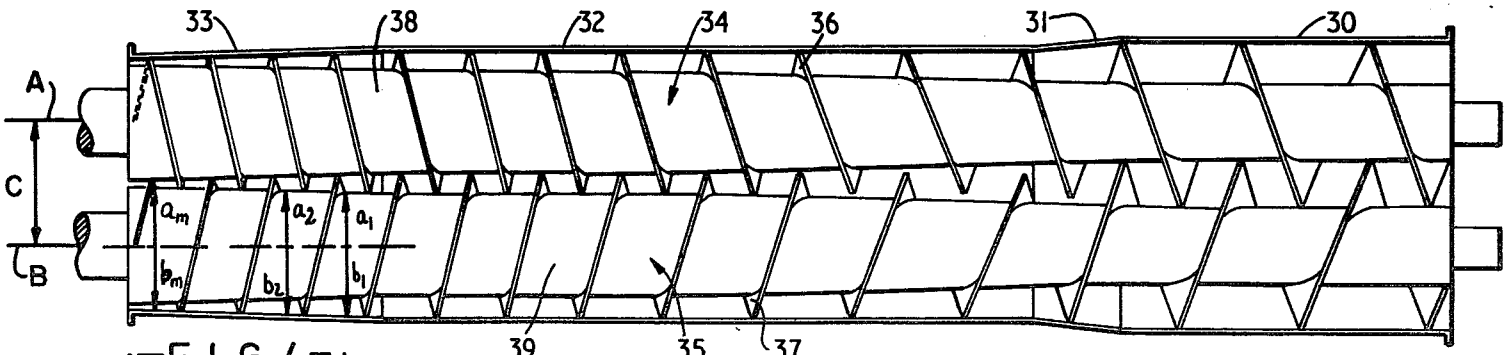
FIG. 4 illustrates a horizontal section of a screw press according to the invention in which the relationship between the inner walls of the press basket and the screw elements is schematically shown.

Referring to FIG. 4, the press basket of the screw press is equipped at the feed end with a first, cylindrical press basket portion 30 which is followed by a second, relatively short, conically tapered press basket portion 31 and a third, relatively extended, cylindrical press basket portion 32 together with a fourth, conically tapered press basket portion 33 at the discharge end. The fourth basket portion 33 may be separately replaceable, that is, removably mounted from the remainder of the press basket portions. The screw threads 36, 37 of the screw elements 34, 35 have an external diameter which corresponds to the inner diameter of the press basket in any radial plane in the longitudinal direction of the press so that a stripping slide abutment is obtained between the screw thread and the inner surface of the press basket in the longitudinal direction of the whole press. In the first press basket portion 30, the cores 38, 39 of the screw elements have a minimum diameter and a substantially cylindrical outer surface or an outer surface with a slightly increasing diameter. In the second press basket portion 31 and in the first part of the third press basket portion 32, the cores 38, 39 have a relatively greatly increasing core diameter, while in the largest part of the third press basket portion 32 the cores 38, 39 have a substantially cylindrical outer surface or an outer surface with a slightly increasing diameter. In the fourth press basket portion 33, the cores 38, 39 have a relatively heavily and uniformly increasing core diameter. Complete thread engagement is achieved between the screw elements mutually (that is the threads of the one screw element contact the core of the adjacent screw element), over approximately 50% of the total length of the screw element. In other words, there is included in this section of 50% of the total length of the screw element, the bulk of the length of the screw elements in the fourth press basket portion 33 (with the exception of the outermost portion of the screw elements which is without threads) and an adjoining substantial portion of the screw elements in the third press basket portion 32. This producer only a central portion of approximately 20–25% of the length of the screw elements having incomplete thread engagement (that is this provides spacing between engaging threads and thereby allows substance to slip between threads of the screw elements).

Figure 5:
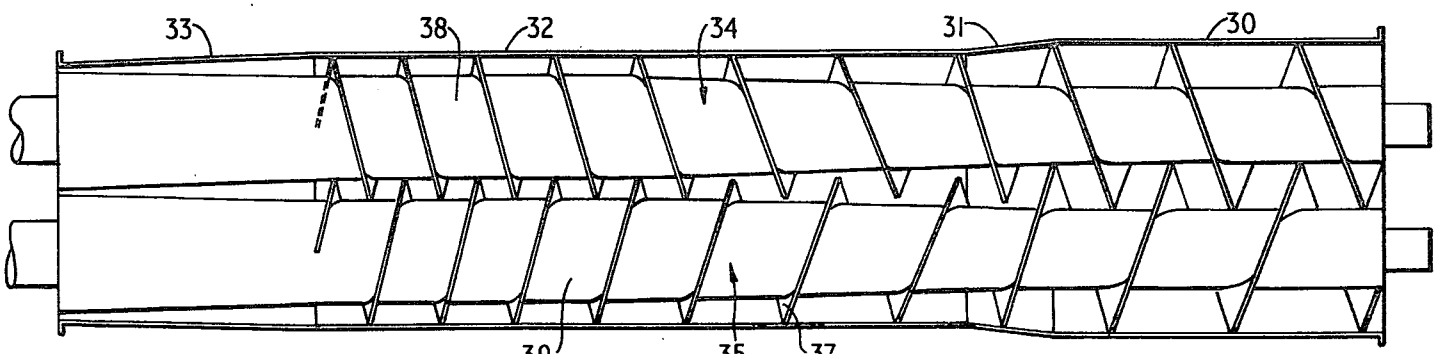
FIG. 5 illustrates a horizontal section of a screw press of a modified embodiment of the invention where the discharge portion is without threads.

The fourth portion 33 of the press basket constitutes approximately 20% of the total length of the screw elements but, if desired, can constitute up to 30% of the total length of the screw elements. In this first embodiment, threads are arranged on approximately the whole of the fourth portion 33. If necessary, threads can be left out of the screw elements in the whole of the fourth portion 33 as shown in the alternative embodiment of FIG. 5.

As shown in FIG. 4, the screw elements are disposed on parallel longitudinal axes A, B which are spaced apart a constant distance C. Further, each core 38, 39 has a radius $a_n$ which increases uniformly in the direction of the discharge end of the press basket while the fourth press basket portion 33 has an internal radius $b_n$ which decreases uniformly in the discharge end direction such that the sum of the internal radius ($b_1$; $b_2$ . . . $b_n$) of the press basket portion 33 and the radius ($a_1$; $a_2$ . . . $a_n$) of the core 38 (39) in any given radial plane of the basket portion 33 is a constant value which corresponds to the distance C between the axes A, B of the screw elements. That is, $a, +b, = a_2 + b_2 = a_n + b_n$.

Figure 6:
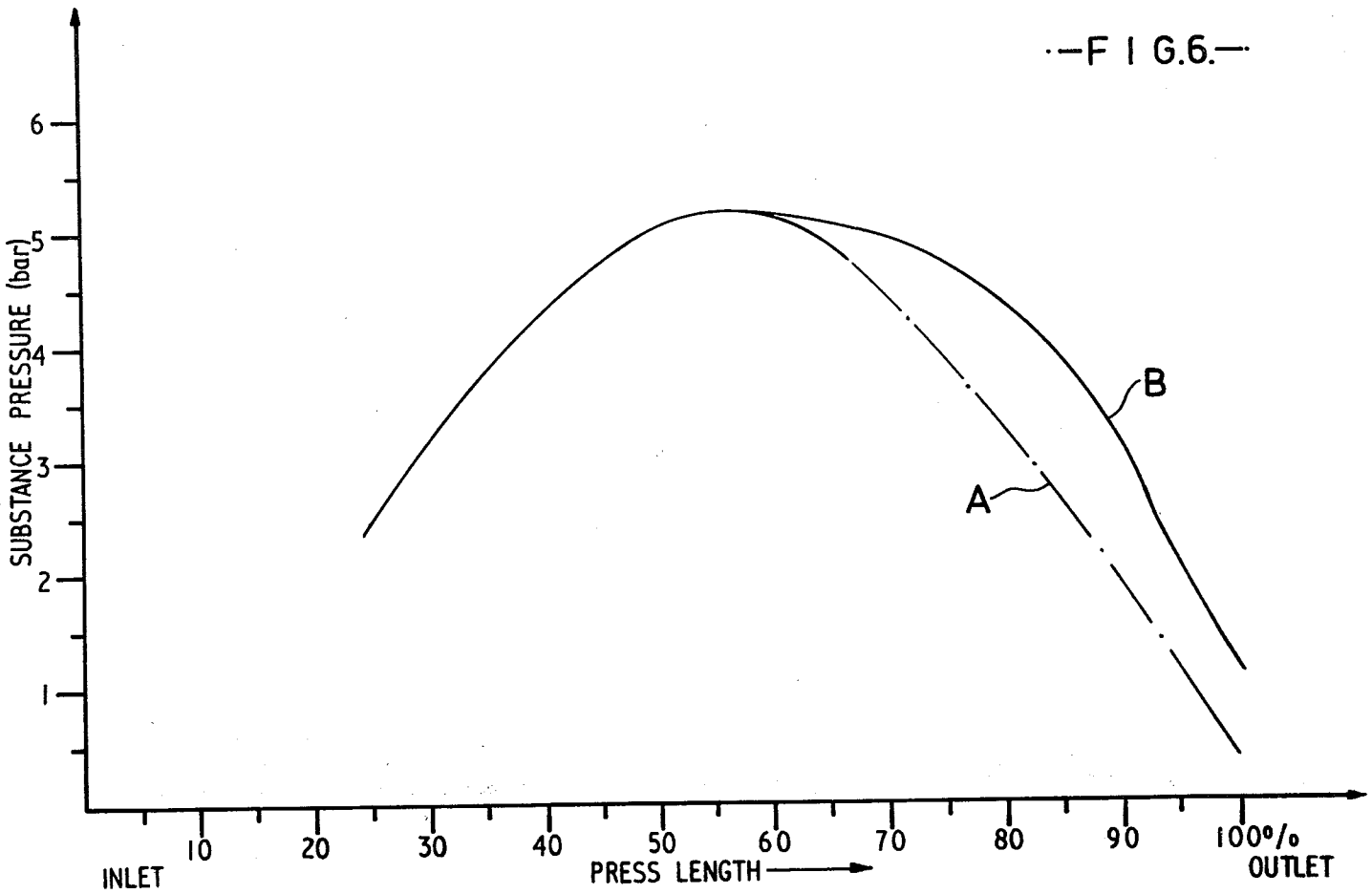
FIG. 6 is a graph comparing the paths of the pressure curves for the material in the respective presses according to the known construction and the invention.

In FIG. 6, there is shown a curve A (chain line) which illustrates the pressure for a particular substance which passes a press according to a known construction and a curve B (full line) which illustrates the pressure for the same substance which passes a press according to the invention. It is evident that will the known construction, a significant pressure drop is obtained towards the discharge end from a point which lies at a distance of 30–40% of the length of the press, reckoned from the discharge. According to the invention there is ensured at a higher pressure level over a greater part of the press length with the same outlet pressure.

Figure 7:
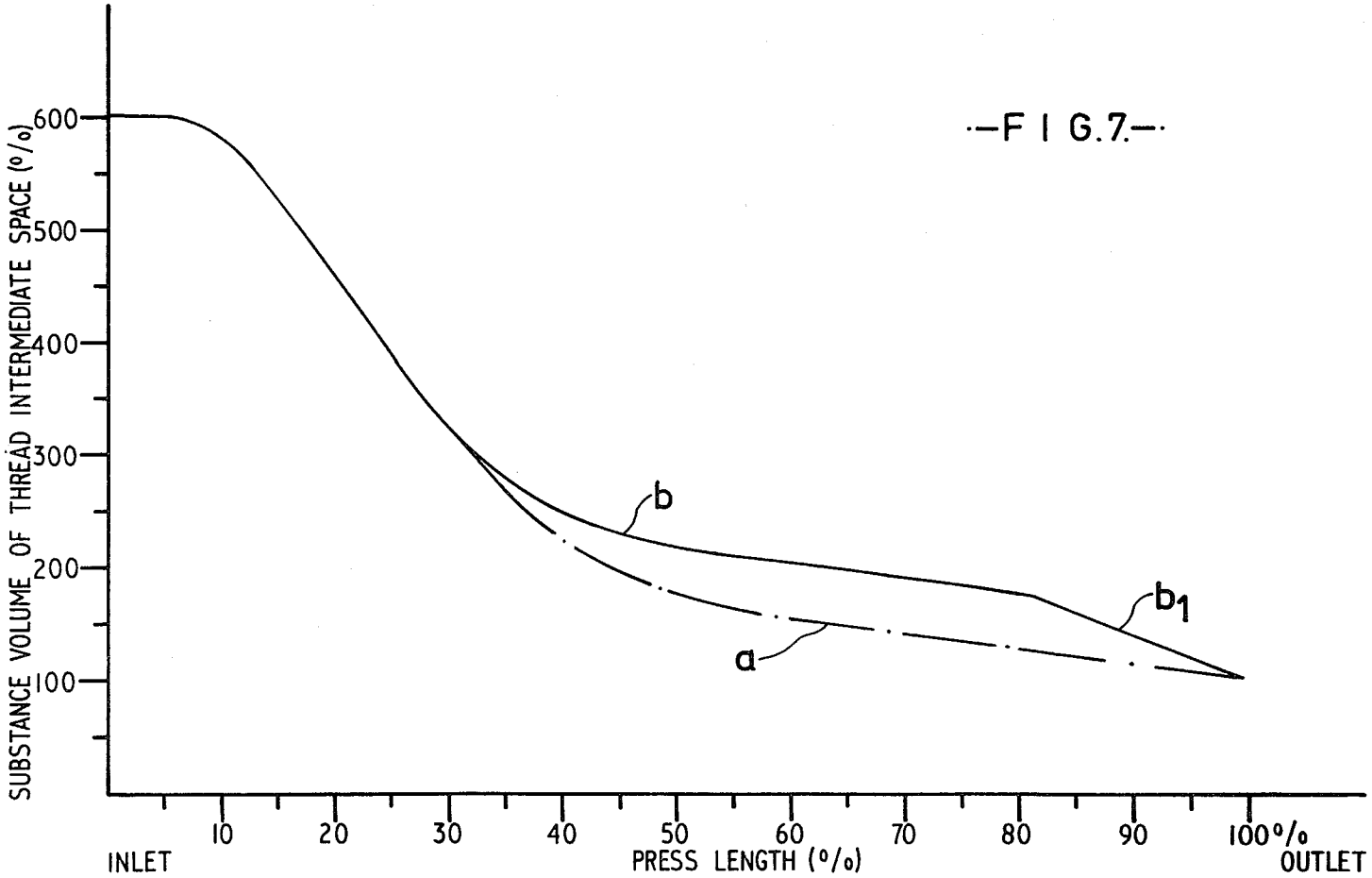
FIG. 7 is a graph comparing the volume curve paths for the material in the respective presses according to the known construction and the invention.

In FIG. 7, there is a shown a curve a (chainline) which illustates the substance volume-path measured at different length distances from the inlet of the press in the known construction and a curve b (fully drawn line) which illustrates the substance volume path in the solution for a corresponding press according to the invention. In the curve portion b, there is illustrated the substance volume path at the conical discharge portion according to the invention.

I claim:

1. A screw press comprising a press basket having a first cylindrical portion at a feed end, a second following tapered portion, a third following cylindrical portion and a fourth following tapered portion at a discharge end; and a pair of screw elements extending through said basket from said feed end to said discharge end in side-by-side relation on parallel longitudinal axes, each said screw element having a core and a screw thread extending from said core, each said core having a minimum diameter within said first basket portion, a greatly increasing diameter in the direction of said discharge end within said second basket portion and a first part of said third basket portion, and a greatly increasing diameter in the direction of said discharge end within said fourth basket portion.

2. a screw press as set forth in claim 1 wherein the sum of the internal radius of said press basket and the radius of said core in any radial plane of said fourth basket portion is a constant value corresponding to the distance between said axes of said screw elements.

3. A screw press as set forth in claim 1 wherein each core has a slightly increasing diameter in the direction of said dischage end within a second part of said third basket portion.

4. A screw press as set forth in claim 1 wherein each core is of constant diameter within a second part of said third basket portion.

5. A screw press as set forth in claim 1 wherein said fourth portion is of a length of between 10% and 30% of the total length of said basket.

6. A screw press arrangement as set forth in claim 1 which further comprises drainage openings for fluid in said basket.

7. A screw press arrangement as set forth in claim 1 wherein each thread extends through said fourth basket portion.

8. A screw press arrangement as set forth in claim 1 wherein said fourth basket portion has a length of approximately 20% of the total length of said basket.

9. A screw press as set forth in claim 1 wherein said fourth basket portion is removably mounted from the remainder of said basket.

10. A screw press as set forth in claim 1 wherein each thread extends to adjacent said press basket in sliding relation over a length of 50% of the total length of said press basket as measured from said discharge end.

* * * * *

UNITED STATES PATENT AND TRADEMARK OFFICE

CERTIFICATE OF CORRECTION

PATENT NO. : 4,438,691

DATED : March 27, 1984

INVENTOR(S) : Per Solberg

It is certified that error appears in the above-identified patent and that said Letters Patent is hereby corrected as shown below:

Column 1, line 31, change "eliminte" to --eliminate--.

Column 1, line 37, change "residues" to --resides--.

Column 1, line 45, New Paragraph "Each screw..."

Column 1, line 45, delete "it".

Column 1, line 52, New Paragraph "The discharge..."

Column 2, line 29, change "preses" to -press--.

Column 3, line 24, change "supplies" to --supplied--.

Column 3, line 43, change "back" to --each--.

Column 4, line 21, change "producer" to --produces--.

Column 4, line 62, delete "a" (first occurrence).

UNITED STATES PATENT AND TRADEMARK OFFICE

CERTIFICATE OF CORRECTION

PATENT NO. : 4,438,691

DATED : March 27, 1984

INVENTOR(S) : Per Solberg

It is certified that error appears in the above-identified patent and that said Letters Patent is hereby corrected as shown below:

Column 4, line 53, change "illustates" to --illustrates--.

Column 5, line 23, change "a" to --A--.

Column 6, line 3, change "dischage" to --discharge--.

Signed and Sealed this

*Twenty-first* Day of *August 1984*

[SEAL]

*Attest:*

GERALD J. MOSSINGHOFF

*Attesting Officer*

*Commissioner of Patents and Trademarks*